US005816963A

United States Patent [19]

Brooks et al.

[11] Patent Number: 5,816,963

[45] Date of Patent: Oct. 6, 1998

[54] SPORTS BATS

[75] Inventors: Richard Brooks; James Stephen Boyd Mather; Stephen Knowles, all of Nottingham, United Kingdom

[73] Assignee: Cadcam Technology Limited, Nottingham, United Kingdom

[21] Appl. No.: 788,774

[22] Filed: Jan. 24, 1997

[30] Foreign Application Priority Data

Jan. 24, 1996 [GB] United Kingdom ..... 9601361

[51] Int. Cl.[6] ..... A63B 59/06

[52] U.S. Cl. ..... 473/564; 773/330

[58] Field of Search ..... 473/332, 330, 473/566, 564, 192, 342, 344, 349, 325, DIG. 22, 282, 318

[56] References Cited

U.S. PATENT DOCUMENTS

| | | | |
|---|---|---|---|
| 4,241,919 | 12/1980 | Foreman | 273/72 A |
| 4,600,193 | 7/1986 | Merritt | 473/566 |
| 4,792,140 | 12/1988 | Yamaguchi | 473/330 |
| 4,809,978 | 3/1989 | Yamaguchi | 473/330 |
| 4,928,965 | 5/1990 | Yamaguchi | 473/330 |
| 5,104,123 | 4/1992 | Okitus | 473/566 |
| 5,209,483 | 5/1993 | Gedney | 473/330 |
| 5,410,798 | 5/1995 | Lo | 473/330 |
| 5,421,572 | 6/1995 | MacKay, Jr. | 273/72 A |

FOREIGN PATENT DOCUMENTS

| | | | |
|---|---|---|---|
| 0 168 041 | 1/1986 | European Pat. Off. . | |
| 5354 | 12/1894 | United Kingdom | 473/192 |

OTHER PUBLICATIONS

British Search Report dated 17 Dec., 1996, British Appl. No. GB 9601361.0.

*Primary Examiner*—Theatrice Brown
*Attorney, Agent, or Firm*—Marshall, O'Toole, Gerstein, Murray & Borun

[57] ABSTRACT

An "isoharmonic" sports bat, for example a baseball bat or cricket bat, includes a hitting surface for impact with a ball, wherein the duration of a half cycle of a selected mode of vibration of the hitting surface when in contact with the ball is approximately equal to the contact time between the hitting surface and the ball during an average impact. This allows the vibrational energy of the bat to be returned efficiently to the ball, which improves the coefficient of restitution, and the peak contact force between the bat and the ball may be reduced. The hitting surface may be formed by a plate attached to the bat.

10 Claims, 4 Drawing Sheets

SPORTS BATS

BACKGROUND OF THE INVENTION

1. Field of the Invention

The invention relates to improving the performance of bats for use in sports. In this specification, the term "bats" is used in a general sense to include cricket, baseball and softball bats; hockey and ice hockey sticks; golf clubs; and any similar racquets, clubs, sticks or bats used in ball impact sports.

2. Description of the Prior Art

The main aims in designing high performance sports bats are to reduce the weight of the bat, to minimize the force of contact between the bat and ball and to maintain or improve the hitting power of the bat. A problem with existing high performance bats is that they are too heavy for many sports players to use effectively and there is a demand for light-weight bats to be produced that have similar hitting power.

One example of a ball striking instrument designed to increase the speed of the struck ball is a golf club disclosed in patent application EP-A-0168041. The club is fabricated so that the mechanical vibration frequency at which the mechanical impedance of the ball striking part takes a minimum value is close to the mechanical vibration frequency at which the mechanical impedance of the ball takes a minimum value, i.e. the natural frequency of the club is matched to the natural frequency of the ball. EP-A-0168041 discloses improvements of up to 5% in the coefficient of restitution using this technique.

In many situations, particularly in sports other than golf, it will not be practical to match the frequency of the striking instrument to that of the ball. (In most sports the nature of the ball is specified by rules and is outside the control of a bat designer.) It is an object of the present invention to provide high performance sports bats of more general application and exhibiting an improved coefficient of restitution compared with the prior art.

SUMMARY OF THE INVENTION

The present invention provides a high performance sports bat using a type of impact that may be termed "isoharmonic". The material and shape of the bat are selected so that the natural frequency of a mode of vibration of the hitting surface of the bat while in contact with the ball is matched to the contact time between the bat and ball. Thus during an impact the hitting surface deflects and returns to approximately its original position as the ball leaves the surface, whereby the energy of the vibration may be sufficiently transferred back to the ball. This improves the hitting power compared with a traditional bat of the same weight or allows the hitting power of a traditional bat to be equalled in a bat of lighter weight according to the invention. At the same time, the invention has the advantage of reducing the peak contact force between the bat and the ball. The approach of the present invention, in which the deflection time is matched to the contact time, is found to be significantly more effective than the prior art approach of matching the natural frequencies of bat and ball.

One way of putting the invention into effect is to provide a hollow bat structure in which the hitting surface is formed by a plate having the desired frequency of vibration. The plate may be of a glass mat thermoplastic (GMT) material or any other material having suitable dimensions and properties, such as reinforced or unreinforced thermoplastic or thermoset materials, metal, rubber, wood or ceramic.

As an alternative to the vibration of a plate forming the impact surface, the isoharmonic impact can be achieved through other modes of vibration, for example about a sprung joint, along a handle or shaft or within a solid blade or head. Different solutions will be appropriate to different types of sports bats (in the broad sense in which that term is used in this specification).

DETAILED DESCRIPTION OF THE PREFERRED EMBODIMENTS

When a ball impacts on a bat, two major mechanisms are in play. The first mechanism is local compression of the materials of the ball and of the bat around the point of contact. In the case of cricket, most of the compression occurs in the ball, the surface of which is of much softer material than the bat. The characteristics of the ball are naturally outside the scope of the bat designer.

The second impact mechanism is overall flexing of the bat. The shape and material of the bat can be chosen to impart desired vibration characteristics, which determine the flexure of the bat during an impact.

In order to understand the mechanics of the impact between a bat and a ball, a mathematical model based upon a cricket bat and a cricket ball was used. For simplicity, the bat was modelled as a rectangular beam supported at each end, with the point of contact of the ball at its centre. The following principles also apply to other boundary conditions e.g. support at only one end of the beam. The variable parameters were: the beam dimensions (length l×width w×thickness d), the Young's modulus E of the bat face and of the ball, the density of the bat material and the input speed v of the ball relative to the bat.

Figure 1A:
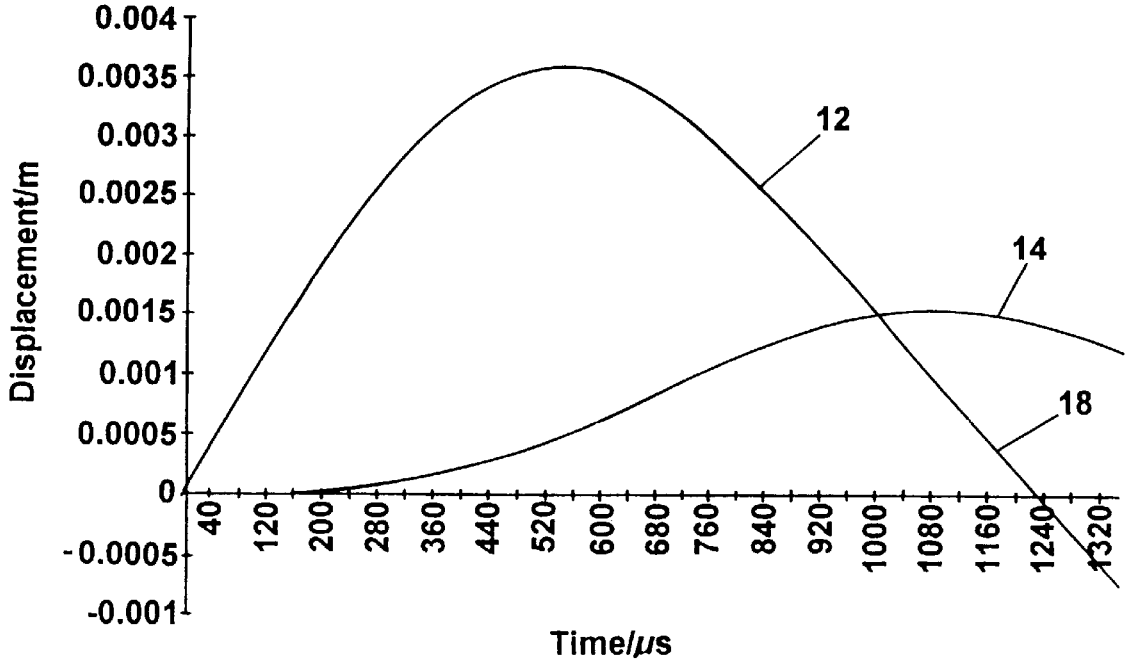
FIG. 1A is a graph plotting against time the displacements of a willow bat and of a ball in a model of the impact between them.
Figure 1B:
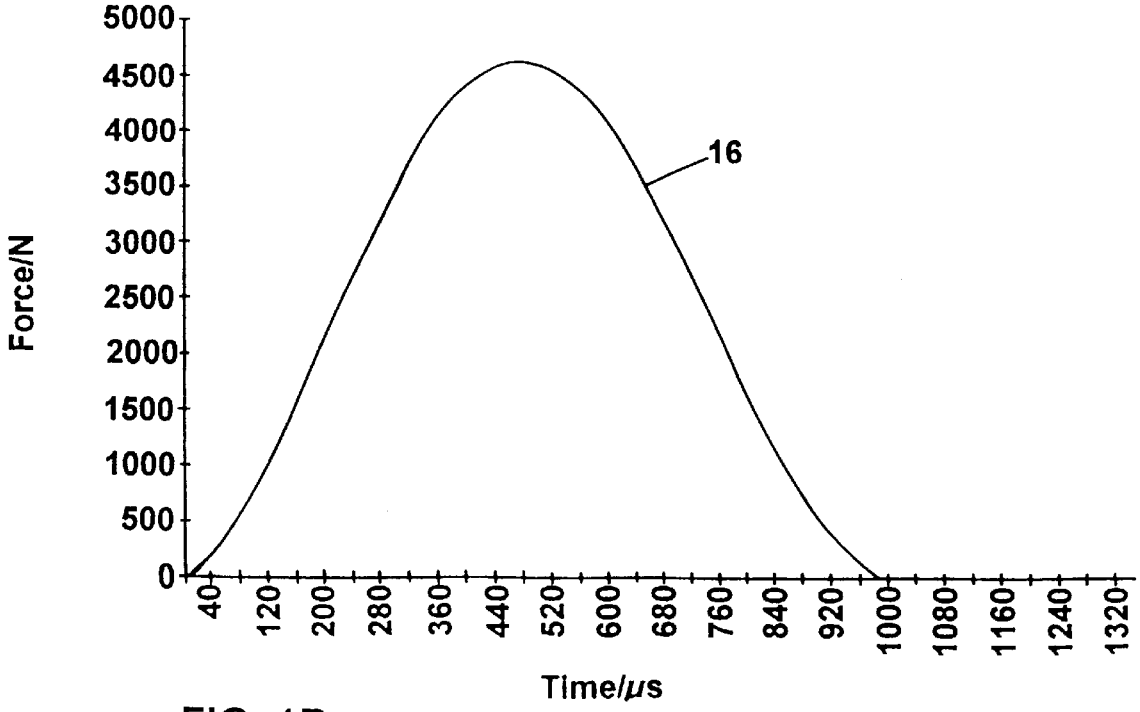
FIG. 1B is a graph plotting against time the force between bat and ball in the model impact of FIG. 1A.

FIGS. 1A and 1B show the results of the model for a willow beam with the following values of the variable parameters:

| | |
|---|---|
| Beam dimensions (l × w × d) | 0.5 × 0.1 × 0.05 m |
| Young's modulus $E_{bat}$ | 9 GPa |
| Young's modulus $E_{ball}$ | 0.09 GPa |
| Ball input speed v | 10 m/s |

In FIG. 1A, curve 12 shows the displacement of the ball over time and curve 14 shows the displacement of the bat over time, both measured relative to the point of impact at time zero. In FIG. 1B, curve 16 shows the changing force that acts between the bat and the ball following the initial impact at time zero.

While the displacement of the ball is greater than the displacement of the bat, as seen in FIG. 1A, the bat and ball are in contact, the difference in displacement being accommodated by compression of the ball and (to a lesser extent) of the bat. When the displacement of the ball becomes less than the displacement of the bat, the bat and ball are no longer in contact and the force between them drops to zero (FIG. 1B). Thereafter the ball emerges travelling at a uniform output velocity, as indicated by the straight line 18 in FIG. 1A. One measure of the performance of the bat is the coefficient of restitution e, which can be assessed by comparing the input and output ball velocities determined from the gradient of curve 12 at the beginning and the end of the impact. In the impact of FIG. 1A the coefficient of restitution was found to be approximately 0.65.

The duration of the impact shown in FIGS. 1A and 1B was 1050 $\mu$s and the peak contact force between bat and ball was 4500N. It is desirable to minimize the peak contact force because a large force can damage the ball and bat. It is also likely to increase the Amount of energy dissipated as noise and heat during the impact, thereby reducing the kinetic energy of the emerging ball. The model employed assumed a purely elastic collision, with no loss of overall kinetic energy, so the calculated coefficients of restitution were higher than might be expected.

The effect on an impact of the flexibility of the material of the bat was tested by using different values of the Young's modulus $E_{bat}$ in the model. The stiffer the bat, the less the impact causes it to vibrate and consequently the more energy is returned to the ball as kinetic energy. However, a stiffer bat also leads to a higher peak contact force. Making the bat more flexible lowers the peak contact force but increases the energy transferred to vibrations of the bat, causing the ball to exit with a lower velocity.

As the flexibility of the bat is further increased in the model, there comes a point at which substantially all of the input kinetic energy of the ball is transferred into vibrations of the bat. After this point the impact mechanism changes and it is this effect that underlies the present invention.

It can be seen in FIG. 1A that the ball springs away from a relatively stiff bat while the bat is still moving backwards from the impact. If the bat is made more flexible so that its vibrations absorb a large proportion of the kinetic energy of the incoming ball, the ball can be made to remain in contact with the bat for a longer time. If that time is long enough for a half cycle of vibration of the bat, whereby the bat is deflected and returns to its original position, the energy of vibration can be returned to the ball, giving it a higher exit velocity. This may be termed an "isoharmonic impact".

A further advantage of an isoharmonic impact is that because the bat and ball move backwards and forwards at similar rates, the contact force between them is much lower. Therefore there is less likelihood of damaging the ball and the collision is less inelastic.

Unfortunately, a bat sufficiently flexible for isoharmonic impact along the whole of its length would generally not have sufficient strength and the effect would depend upon the point of impact along the length of the bat. An alternative is to provide a relatively stiff bat structure allowing for local deflection around the impact point. This can be achieved by using a flexible plate arrangement for the face of the bat.

Figure 2A:
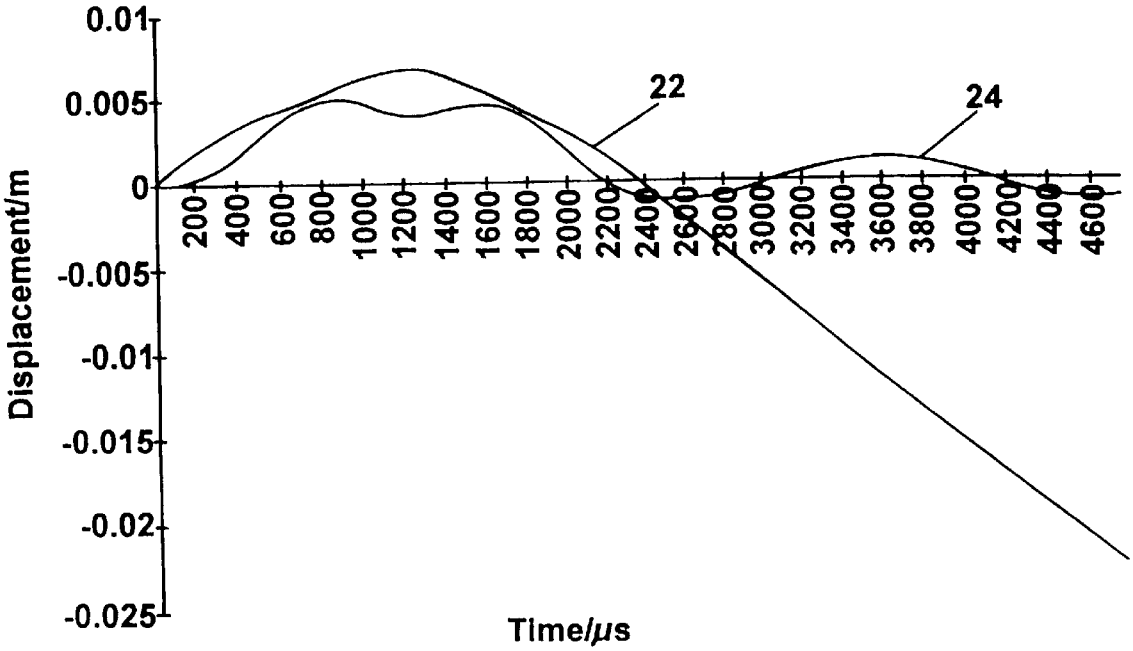
FIG. 2A is a graph plotting against time the displacements of a thin GMT plate and of a ball in a model of the impact between them.
Figure 2B:
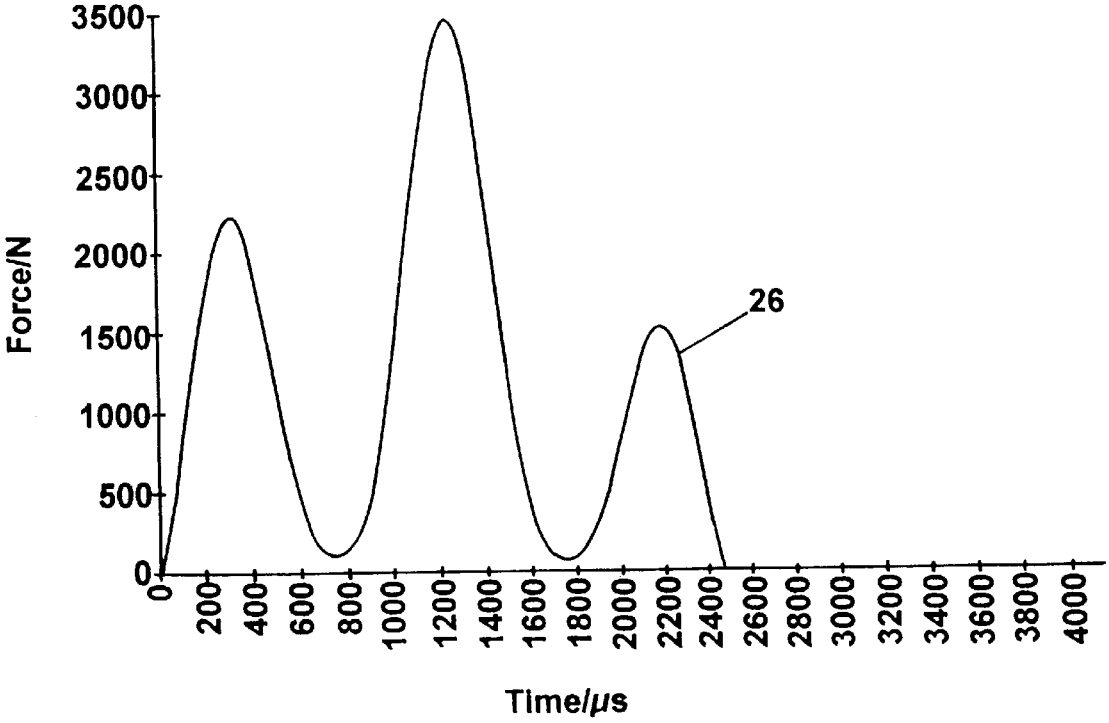
FIG. 2B is a graph plotting against time the force between the GMT plate and the ball in the model impact of FIG. 2A.

FIGS. 2A and 2B show the results of the same model for a thin glass mat thermoplastic (GMT) plate forming the impact face of a hollow bat. The values of the variable parameters were as follows:

| | |
|---|---|
| Beam dimensions (l × w × d) | 0.11 × 0.15 × 0.005 m |
| Young's modulus $E_{plate}$ | 8 GPa |
| Young's modulus $E_{ball}$ | 0.09 GPa |
| Ball input speed v | 10 m/s |

These values, particularly the small thickness, make the plate much less rigid than the willow beam in the example of FIG. 1. In FIG. 2A, curve 22 shows the displacement of the ball over time and curve 24 shows the displacement of the bat face over time, both measured relative to the point of impact at time zero. In FIG. 2B, curve 26 shows the changing force that acts between the bat and the ball following the initial impact at time zero.

The duration of the impact shown in FIGS. 2A and 2B was 2470 $\mu$s, which may be seen from FIG. 2A to be approximately equal to half a cycle of the first mode of vibration of the face plate so that the ball leaves the plate when the plate returns to its initial undeformed position. The ball exits with a high velocity and the coefficient of restitution in this impact was found to be approximately 0.95.

The second mode of vibration of the plate causes a fluctuation in the amount of compression of the ball during the contact period. This results in large variations in force, as shown in FIG. 2B. However, the peak impact force is reduced to 3500N.

The second and higher modes of vibration, besides affecting the compression of the ball during the contact period, may alter the time taken for the hitting surface to return to its undeflected position. In theory, the maximum coefficient of restitution would be obtained if all modes of vibration returned to their undeflected shapes simultaneously. In practice, this does not occur but an optimum arrangement can be found using computer modelling.

It should be understood that the modes of vibration of the hitting surface during an impact may not be the free modes of vibration of the bat. The time taken for the bat face to deflect and return to near its original position depends not only on the stiffness and mass distribution of the bat face but also on the combined mass of the bat and the ball. However, the stiffness and natural frequency properties of the ball are found to have little effect.

The contact time between the bat and the ball depends on a complex relationship between a large number of factors. These include the mass of the bat and the ball; the stiffness, geometry and vibrational characteristics of the bat; the speed of impact; and, to a much lesser extent, the size and stiffness of the ball. The free vibration characteristics of the ball do not play a significant role.

Figure 3:
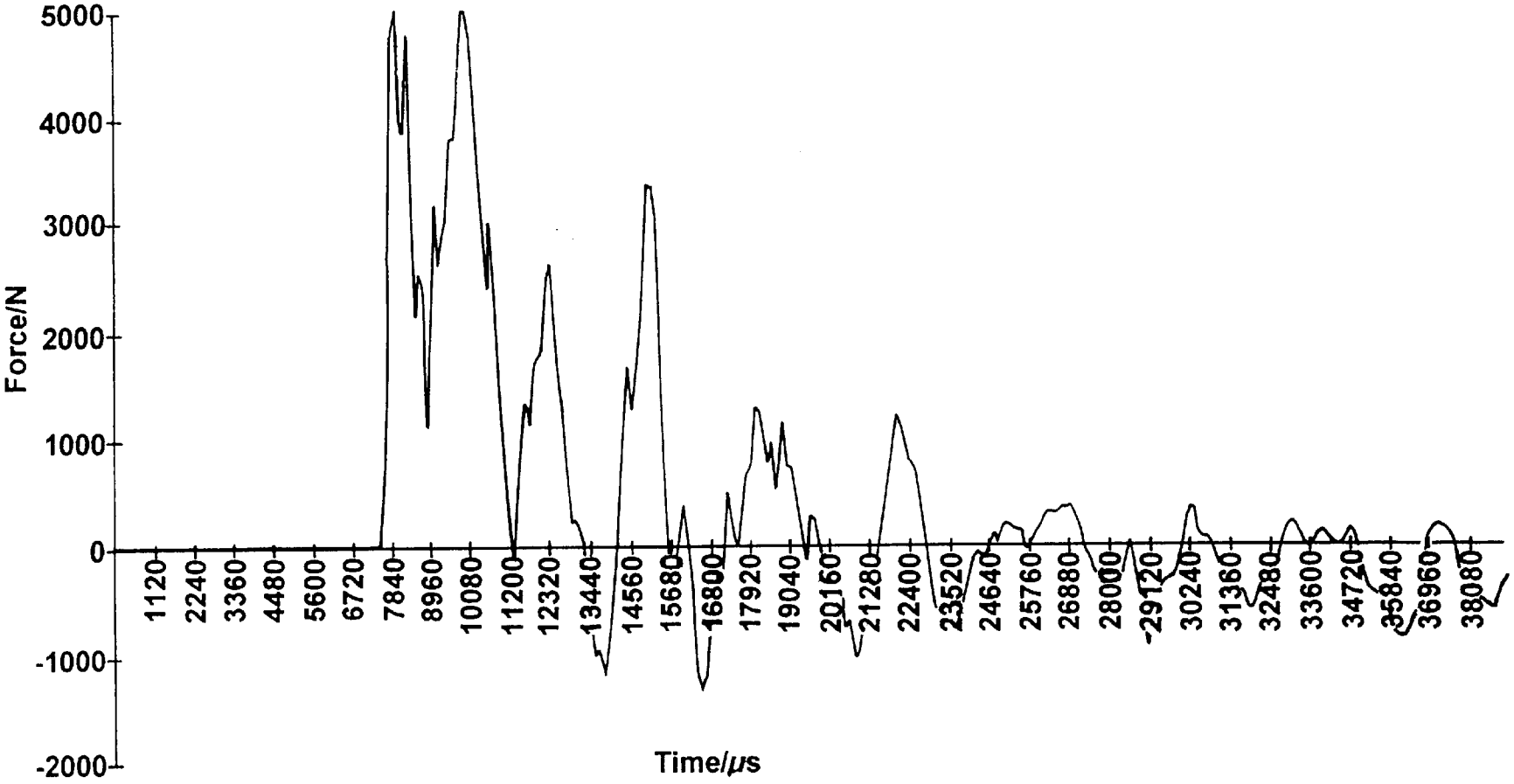
FIG. 3 is a graph plotting against time the measured force between a cricket ball and a GMT plate in an experimental test of the impact between them.

Laboratory experiments have been carried out in which cricket balls were fired at targets of various materials. The results for a willow beam closely matched the predictions of the model previously described. FIG. 3 is a graph of the measured force of impact of a cricket ball on a plate of VERTON, which is a long glass fibre reinforced nylon. The input speed of the ball was 18.7 m/s. The characteristic multi-peaked curve shows that isoharmonic impact occurred.

The model described above can be used in an iterative procedure to design a bat having the desired characteristics. Having initially selected a material and a likely plate geometry, the model is used to test the design for an average impact. If isoharmonic impact is found not to have occurred, the geometry of the plate may be changed, for example by reducing its thickness to increase flexibility, until the isoharmonic effect is found for that impact. The model also allows calculation of the stress on the bat and ball during the average impact. If the stress is too great, the plate geometry or the material may be changed to provide higher strength but lower stiffness. When a design appears to give isoharmonic impact at acceptable stress levels for the average impact, other types of impact can be tested using the model.

Figure 4A:
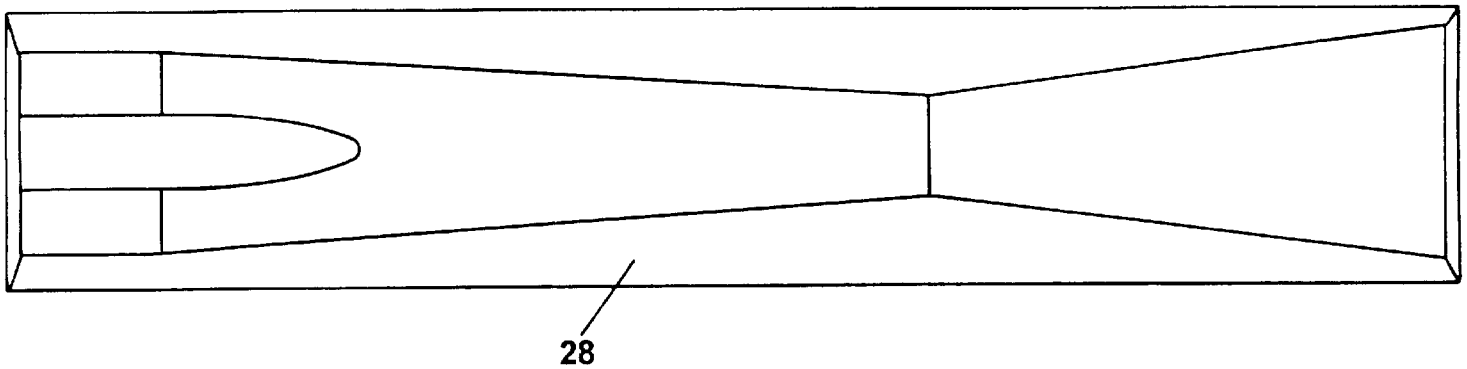
FIGS. 4A, 4B and 4C illustrate the blade of a cricket bat manufactured in accordance with the present invention, being respectively a rear view, a side view and a cross section on line A—A.
Figure 4C:
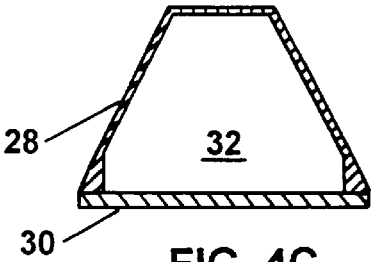
Figure 4B:
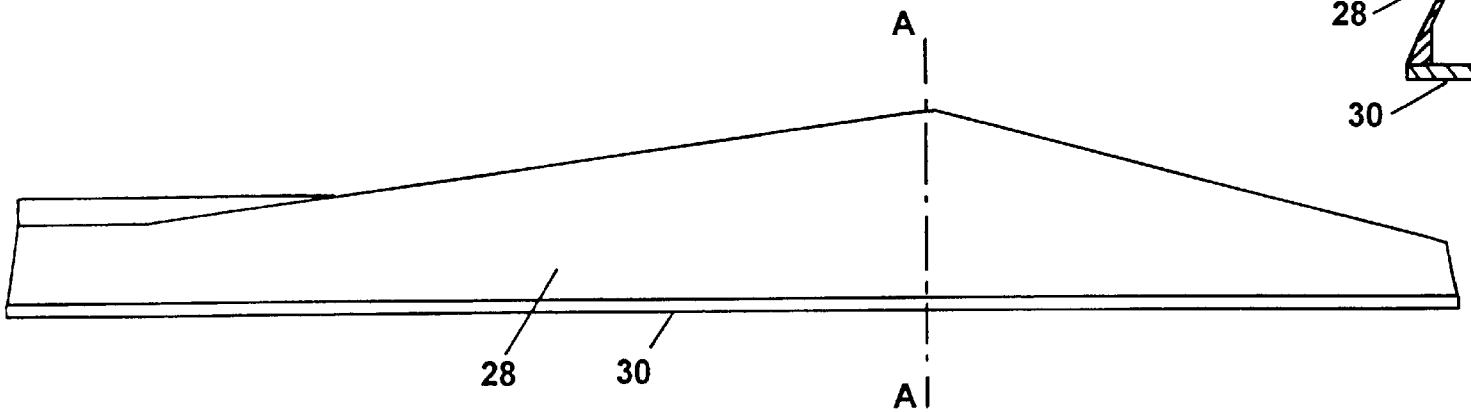

FIG. 4 illustrates an example of the blade of a cricket bat manufactured in accordance with the present invention. The bat comprises a main body 28 and a flat front face 30, defining between them a hollow space 32. The main body is compression moulded from GMT and the front face, which may also be of GMT, is welded on. The plate covers the full length of the bat and for points of impact near the centre line of the bat the isoharmonic effect occurs anywhere along its length. By contrast, in a traditional bat the hitting power depends on the position along the bat of the point of impact. For impacts near the edge of the bat according to the invention, the isoharmonic effect is reduced and the bat behaves more like a traditional bat.

We claim:

1. A sports bat including a hitting surface for impact with a ball, wherein the hitting surface has a selected mode of vibration when in contact with the ball such that the duration of a half cycle of the selected mode of vibration is approximately equal to a contact time between the hitting surface and the ball during an average impact.

2. A sports bat according to claim 1, wherein the selected mode of vibration is a lowest frequency mode of vibration of the hitting surface when in contact with the ball.

3. A sports bat according to claim 1, wherein the bat further comprises a plate, said plate defining the hitting surface.

4. A sports bat according to claim 3, wherein the plate is of a glass reinforced thermoplastic material.

5. A sports bat according to claim 3, the bat further comprising a body element, said body element and said plate defining a hollow region therebetween.

6. A sports bat according to claim 1, being a baseball bat.

7. A sports bat according to claim 1, being a cricket bat.

8. A combination of a sports bat and a ball, wherein:

the bat includes a hitting surface for impact with the ball; and during a typical impact between the bat and the ball, the bat is in contact with the ball for a predetermined contact time;

the hitting surface of the bat having a selected mode of vibration when in contact with the ball such that the duration of a half cycle of the selected mode of vibration is approximately equal to said predetermined contact time.

9. A method of producing a sports bat comprising the steps of:

(a) selecting an initial shape and material for a hitting surface of the bat;

(b) modelling an average impact between a ball and the hitting surface to determine the contact time between the ball and the hitting surface during the impact and the duration of a half cycle of the lowest frequency mode of vibration of the hitting surface during the impact;

(c) if the determined contact time and half cycle duration are not approximately equal, adjusting the shape or the material of the hitting surface and returning to step (b);

(d) manufacturing a sports bat including a hitting surface of a shape and material determined in step (b) to have a contact time approximately equal to the duration of a half cycle of the lowest frequency mode of vibration during an average impact.

10. A method of producing a sports bat according to claim 9, wherein in step (b) the peak contact force between the ball and hitting surface during the impact is determined;

and including after step (c) a further step of adjusting the shape or the material of the hitting surface and returning to step (b) if the determined peak contact force exceeds a predetermined maximum value.

* * * * *